United States Patent [19]

Kiritani et al.

[11] Patent Number: 4,543,269

[45] Date of Patent: Sep. 24, 1985

[54] PROCESS FOR PRODUCING SUPPORTS FOR PHOTOGRAPHIC PAPER

[75] Inventors: Masataka Kiritani; Yasuzi Asao; Takashi Takayanagi, all of Shizuoka, Japan

[73] Assignee: Fuji Photo Film Co., Ltd., Japan

[21] Appl. No.: 629,867

[22] Filed: Jul. 11, 1984

[30] Foreign Application Priority Data

Jul. 11, 1983 [JP] Japan ..... 58-125646

[51] Int. Cl.[4] ..... B05D 3/06

[52] U.S. Cl. ..... 427/44; 427/54.1

[58] Field of Search ..... 427/44, 54.1

[56] References Cited

U.S. PATENT DOCUMENTS 3,713,935 1/1973 Grecchi ..... 427/54.1
4,113,894 9/1978 Koch ..... 427/44
4,322,450 3/1982 Gray et al. ..... 427/44
4,364,971 12/1982 Sack et al. ..... 427/44
4,435,461 3/1984 Gray et al. ..... 428/141

*Primary Examiner*—John H. Newsome
*Attorney, Agent, or Firm*—Sughrue, Mion, Zinn, Macpeak, and Seas

[57] ABSTRACT

A process for producing supports for a photographic paper which comprises applying a layer of a composition containing an unsaturated organic compound capable of being polymerized or hardened upon irradiation with electron beams and an inorganic white pigment to a support, irradiating the layer with a first irradiation with electron beams to imcompletely harden the unsaturated organic compound, pressing the incompletely hardened layer against the surface of a roll to transfer the surface configuration of the roll to the layer, and then further irradiating the layer with a second irradiation with electron beams to more fully harden the unsaturated organic compound in the layer.

7 Claims, No Drawings

PROCESS FOR PRODUCING SUPPORTS FOR PHOTOGRAPHIC PAPER

FIELD OF THE INVENTION

The present invention relates to a process for producing supports for photographic paper having a desired surface configuration.

BACKGROUND OF THE INVENTION

Several processes are known to produce photographic papers having various patterns on the surface. One process comprises forming a pattern after conclusion of all photographic processings such as development and fixation, etc. However, this process is not suitable for mass processing and a high cost with respect to processing rate or processing apparatus, etc., is involved. A second process involves forming a pattern after application of the photographic emulsions. There are disadvantages with this process because it is not photographically suitable since a physical force is applied to the surface of the emulsion layer and there is the difficulty in production because formation of a pattern must be carried out in a dark room. A third process involves applying photographic emulsions to the support after the formation of pattern on the support. The last process is most advantageous from the standpoint of the work involved.

Suitable supports for photographic papers are papers, the both sides of which are coated with polyolefin in order to provide a waterproof property. In order to form a pattern on the surface of the support, generally a process is employed which comprises pressing a cooling roll having a desired engraved pattern onto a paper support where extrusion coating of polyolefin on the paper support is used.

Recently, attempts have been made to provide a waterproof property to the support by applying an organic compound having an unsaturated bond capable of being polymerized upon irradiation of electron beams instead of a polyolefin to a paper support and hardening the compound by irradiation with electron beams (Japanese Patent Applications (OPI) Nos. 27257/82 (corresponding to U.S. Pat. No. 4,384,040, hereinafter the same), 30830/82 (U.S. Pat. No. 4,364,971) and 49946/82 (U.S. Patent Application Ser. No. 300,526, 9-9-81) (the term "OPI" as used herein refers to a "published unexamined Japanese patent application")).

In this process, the formation of a pattern, such as forming a silk fabric pattern or a mat pattern, etc., is not known. Further, a process for producing a glossy surface is described in the above-described Japanese Patent Application (OPI) No. 30830/82. This process comprises irradiating the compound with an electron beam from the back of a paper support, where a glossy surface is pressed against the unhardened coated surface to harden the compound and thereafter separating the hardened surface from the molding surface. This process has the disadvantage that lateral defects occurs in separating the hardened coated surface from the molding surface. The term "lateral defects" used in this specification is a wave-like uneven thickness of the coating layer in the longitudinal direction of the web which occurs due to a small difference in thickness of the coated surface, and a fatal disadvantage in quality of the photographic paper arises. Further, in this process, since an electron beam is applied through the paper support and this results in a great loss, an electron beam irradiation apparatus having a large capacity must be used. Consequently, the equipment investment becomes great.

SUMMARY OF THE INVENTION

Research has been conducted on a process which can be applied to both the formation of a pattern such as a silk fabric pattern or a mat pattern, etc., and the formation of a glossy surface without having the above-described disadvantages, and thus the present invention has been achieved.

The present invention provides a process which comprises applying a composition containing an unsaturated organic compound capable of being polymerized or hardened upon irradiation with electron beams and an inorganic white pigment to a support, incompletely hardening the unsaturated organic compound in the coated layer by a first irradiation with electron beams to change the layer into a state capable of being deformed by pressure but without the layer being sticky, thereafter pressing the compound layer against the surface of a roll to transfer the configuration of the roll surface into the layer, and irradiating the layer with a second irradiation with electron beams to further harden the layer.

DETAILED DESCRIPTION OF THE INVENTION

Unsaturated organic compounds capable of being polymerized or hardened upon irradiation with electron beams, which can be used to produce a pigment layer in the present invention, include essentially all polymerizable or hardenable compounds having at least one C=C double bond per molecule. Preferably, these compounds have at least two and more preferably three or four C=C double bonds per molecule, and have a molecular weight ranging from about 300 to 20,000. In order to obtain a pigment layer having a surface with scratch resistance which is also flexible, it is advantageous to use mixtures of unsaturated resins or unsaturated prepolymers and unsaturated monomers such as vinyl monomers as the unsaturated organic compounds of the present invention so as to make possible a controlled cross-linking during polymerization. It is possible to use alone the above-described unsaturated resin, unsaturated prepolymer or unsaturated monomer. However, use of the unsaturated monomer alone results in the formation of coating which is too brittle.

Suitable resins and prepolymers used in the present invention include compounds containing an acryloyl group, a methacryloyl group, an acrylamido group, a vinyl ether group, or a vinyl thioether group, and unsaturated polyesters. Particularly preferred are unsaturated polyesters, unsaturated polyacrylates, and unsaturated polycarbonates as described in *A. Vrancken Fatipec Congress,* Vol. 11, p. 19 (1972).

Examples of these resins and prepolymers are as follows:

Acryl esters of aliphatic polyurethanes (molecular weight: about 500–5,000).

Acryl esters of terephthalic acid-diol (or polyol)-polyesters (molecular weight: about 500–5,000).

Acryl esters of dihydric or polyhydric polyether alcohols (molecular weight: about 500–5,000)

Acryl esters of methylolmelamine resins (molecular weight: about 500–5,000)

Maleic acid esters of polyesters (molecular weight: about 500–5,000)

Acryl esters of bisphenol A-epoxy resins (molecular weight: about 800–5,000)

Unsaturated polyester resins (molecular weight: about 500–5,000)

Styrene/butadiene copolymer resins (molecular weight: about 500–5,000)

Acrylic acid esters of hydrolyzed starch or hydrolyzed cellulose (molecular weight: about 500–5,000)

Fumaric acid-diol-polyesters (molecular weight: about 500–5,000)

Examples of suitable monomers capable of being polymerized or hardened with electron beams are as follows.

Acrylic acid esters or methacrylic acid esters of monohydric or dihydric alcohols having at least one $—CH_2—$group present (for example, hexanediol diacrylate and hydroxyethyl methacrylate, etc.), acrylic acid esters or methacrylic acid esters of monohydric or dihydric ether alcohols having a $—(CH_2—CH_2—O)_n—$ group (wherein n is 1 or $>1$) (for example, diethylene glycol diacrylate), mono-, di-, tri-, tetra- or pentaacrylates of polyhydric alcohols (for example, trimethylolpropane triacrylate, neopentyl glycol diacrylate and methacrylate, and pentaerythritol triacrylate, etc.), cyanoethyl acrylate Glycidyl acrylate and methacrylate Allyl acrylate Cyclohexyl methacrylate Diallyl fumarate Divinylbenzene In principle, all other vinyl compounds can be used, of course. However, since many of these compounds are volatile, it is impossible actually to use them without difficulties arising.

In order to improve the scratch resistance and to control the hardness of the pigment layer, an unhardenable resin having preferably a molecular weight of about 1,000 to 7,000 may be added to the pigment layer. The following resins are examples of these types of resins.

Cellulose esters

Polyvinyl butyrals

Polyvinyl acetates and vinyl acetate copolymers

Unhardenable polyester resins

Styrene/acrylate resins

Polystyrene resins

Preferable mixing ratio of the unhardenable resin to the unsaturated organic compound is from about 1/99 to 30/70 (by weight).

Suitable inorganic white pigments which can be used are $TiO_2$, ZnO, $SiO_2$, $BaSO_4$, $CaSO_4$, $CaCO_3$, talc and clay, etc. However, inorganic white pigments which can be used are not limited to the above-described substances.

Further, all known white inorganic pigments, such as $TiO_2$ subjected to coating processing with organic compounds or $TiO_2$ subjected to coating processing with various inorganic compounds in order to improve dispersibility of the inorganic white pigments or to improve yellowing by the passage of time, etc., can also be used.

The average particle size of the white inorganic pigments used in the mixture according to the present invention is a particle size of more than about 0.1 $\mu$m (preferably more than 0.15 $\mu$m). If the particle size is 0.1 $\mu$m or less, the desired improved resolving power is not obtained.

Addition of dyes having a blue, violet or red color to the mixture colored white may be carried out for the purpose of adjusting the subjective impression of the white color of the layer to a more acceptable color. Further, inorganic colored pigments such as ultramarine, cobalt blue, cobalt violet or cadmium red and organic colored pigments such as phthalocyanine pigments can be used, if desired.

For the purpose of special use, a large amount of pigments which color thick can be added, for example, as an antihalation agent. Particularly, in coated papers used for the silver salt-diffusion coating process, carbon black or finely divided graphite is present in a water-resistant lacquer layer for such a purpose. In this case, attention does not need to be paid to pigments having a particle size of less than the limit.

The white inorganic pigment preferably is present in an amount of about 20 to 70% by weight in the hardenable coating composition.

In order to control the viscosity of the coating composition or to improve the coating ability, organic solvents may be added to the above-described coating composition. Suitable organic solvents which can be used include ketones such as acetone, methyl ethyl ketone, methyl isobutyl ketone or cyclohexanone, etc., esters such as methyl acetate, ethyl acetate, butyl acetate, ethyl lactate or acetic acid glycol monoethyl ether, etc., ethers such as ethyl ether, glycol dimethyl ether, glycol monoethyl ether or dioxane, etc., tars (aromatic hydrocarbons) such as benzene, toluene or xylene, etc., and chlorinated hydrocarbons such as methylene chloride, ethylene chloride, carbon tetrachloride, chloroform, ethylene chlorohydrin or dichlorobenzene, etc.

Suitable paper supports which can be used in the present invention include base papers containing a neutral sizing agent such as alkyl ketene dimer, etc., or a sizing agent such as resin soap, aliphatic acid soap, aliphatic acid anhydride or carboxyl modified polyvinyl alcohol, etc.

Further, it is advantageous for the papers to contain pigments and/or antistatic agents.

The base papers can suitably have a weight of about 60 to 300 g/m$^2$ (preferably 80 to 200 g/m$^2$). These can be produced from cellulose fibers or from a mixture of cellulose fibers and synthetic fibers.

If paper supports coated with polyolefins such as polyethylene, etc., are used, supports for photographic printing paper which have more excellent surface property and no pinholes can be obtained.

In order to knead and disperse the composition, various kinds of kneaders can be used. Examples of suitable kneaders include two-roll mills, three-roll mills, ball mills, pebble mills, sand grinders, attriters, high speed impeller dispersing machines, high speed stone mills, high speed impact mills, disperse kneaders, high speed mixers, homogenizers and ultrasonic dispersing machines, etc.

Techniques concerning kneading and dispersing have been described in T. C. Patton, *Paint Flow and Pigment Dispersion* (1964, published by John Wiley & Sons Co.) and U.S. Pat. Nos. 2,581,414 and 2,855,156.

Methods of applying the above-described composition to the support which can be used include air doctor coating, blade coating, air knife coating, squeeze coating, impregnation coating, reverse roll coating, transfer roll coating, gravure coating, kiss coating, cast coating, spray coating and spin coating, etc. Other methods can be used, too. These methods are described in detail in

*Coating Technology*, pages 253–277, published by Asakura Shoten (Mar. 20, 1971).

The coating layer preferably has a thickness of about 3 to 100 μm and preferably 5 to 50 μm. If the thickness deviates from the above-described range, unevenness of coating occurs and a large amount of energy is required for hardening or insufficient hardening may occur.

Exemplary electron beam accelerators include a van de Graaff type scanning system, a double scanning system and a curtain beam system, and a curtain beam system by which a large output is obtained at a comparatively low cost is preferred.

The first irradiation of electron beams must be carried out at an absorbed dose insufficient to completely harden the coating composition. Specifically, after the first irradiation with electron beams, the coating layer should still be deformable due to the pressure of a calender roll or an embossing roll. This characteristic is obtained when the conversion of the unsaturated organic compound in the coating layer is up to about 80%, preferably 15 to 75% and more preferably 20 to 60%. The second irradiation with electron beams must be carried out at an absorbed dose sufficient to nearly completely harden the coating layer. The conversion of the unsaturated organic compound in this case is 80% or more, preferably 90% or more, and more preferably 95% or more.

The term "conversion" as used in this specification means the percentage by weight of a polymerized or hardened unsaturated organic compound which remains unextracted when the unpolymerized or unhardened organic compound in the coating layer is extracted with a solvent for the unsaturated organic compound in relation to the total amount of the unsaturated organic compound used.

As described above, control of the conversion is carried out by controlling the absorbed dose.

The absorbed dose of the second irradiation with electron beams is larger than the absorbed dose of the first irradiation with electron beams.

It is generally preferred for the first irradiation with electron beams to be carried out at an absorbed dose of up to about 1 M Rad. and the second irradiation with electron beams is carried out at an absorbed dose of about 1 to 10 M Rad.

In the first irradiation with electron beams, the depth at which the electron beams arrive can be controlled by controlling the acceleration voltage, by which it is possible to harden only the surface so that the inner portion remains in an unhardened state or a state having a low conversion.

In order to prevent obstruction of the hardening reaction by oxygen in the air, air is replaced by nitrogen gas during the irradiation with electron beams. It is possible to control the conversion so as to maintain a low conversion by leaving oxygen in the atmosphere for the first irradiation with electron beams.

Between the step of the first irradiation with electron beams and the step of the second irradiation with electron beams, the coating layer is pressed against a roll to transfer the surface configuration of the roll. The surface configuration of the roll can be appropriately selected depending on the surface configuration desired for the support for a photographic paper.

In order to obtain a smooth surface, a calender roll having a smooth surface, subjected to mirror finishing, can be used.

In order to obtain a mat surface or a silk fabric face, an embossing roll having an unevenness of about 5 to 50 microns (depth) can be used. In the present invention, the pressure for pressing the roll may be very low as compared with the case of the formation of a pattern of a completely hardened coating layer. Since a linear pressure of about 10 to 100 kg/cm is sufficient for use, wrinkles occur to a lesser extent and the process of the present invention can be advantageously carried out.

After the second irradiation with electron beams, the surface of the coating layer may be subjected to a surface treatment, such as corona treatment or a subbing layer applied, for the purpose of improving the adhesive properties to a light-sensitive emulsion layer. Further, an antistatic agent and the like may be added to the composition of the present invention.

In the present invention, it is necessary for the composition containing an unsaturated organic compound capable of being polymerized or hardened upon irradiation with electron beams and an inorganic white pigment to be applied to at least one side of the paper support. The composition may be applied to both sides, but the object of the present invention can be also attained when such a composition is applied to only one side and the same composition as described above except that the inorganic white pigment is not present is applied to the other side.

The effect of the present invention is illustrated in greater detail by reference to the following examples. Unless otherwise indicated, all parts, percents, ratios and the like are by weight.

EXAMPLE 1

| | parts |
|---|---|
| Titanium Oxide | 50 |
| Urethane Type Acrylate Oligomer (molecular weight: about 1,000, two C=C double bonds per molecule) (described in U.S. Pat. No. 4,092,173) | 40 |
| Diethylene Glycol Diacrylate | 30 |
| Acetone | 200 |

After the above-described composition was stirred in a ball mill for 20 hours, the composition was applied to a sheet of paper (thickness: 300 μm) so as to result in a dry thickness of 20 μm, and dried. Then, electron beams were applied at an acceleration voltage of 120 kv to provide an absorbed dose of 0.5 M Rad. at the surface of the applied layer. The conversion of the unsaturated organic compound was about 52%.

The formation of a pattern was then carried out by pressing the layer on the paper sheet against a metal embossing roll with uniform conical hollows with a depth of 12 μm and a diameter of 400 μm on the surface at a linear pressure of 45 kg/cm, and thereafter electron beams were applied to provide an absorbed dose of 3 M Rad at the surface of the applied layer. The conversion was about 98%. As the result, a support for photographic paper having a fine silk fabric pattern was obtained. No lateral defects on the surface of the support was formed upon separation from the embossing roll.

EXAMPLE 2

A support for a photographic paper having a smooth surface was obtained using the same procedures as described in Example 1, except that the embossing roll in Example 1 was replaced with a stainless steel roll having a smooth surface. No lateral defects on the surface was formed upon separation from the metal roll.

While the invention has been described in detail and with reference to specific embodiments thereof, it will be apparent to one skilled in the art that various changes and modifications can be made therein without departing from the spirit and scope thereof.

What is claimed is:

1. A process for producing supports for a photographic paper which comprises applying a layer of a composition containing an unsaturated organic compound capable of being polymerized or hardened upon irradiation with electron beams and an inorganic white pigment to a support, irradiating the layer with a first irradiation with electron beams from the coated side prior to contacting with the surface of a roll to incompletely harden the unsaturated organic compound, pressing the incompletely hardened layer against the surface of a roll to transfer the surface configuration of the roll to the layer, and then after removal from the roll, further irradiating the layer with a second irradiation with electron beams from the coated side to more fully harden unsaturated organic compound in the layer.

2. The process of claim 1, wherein said unsaturated organic compound is a compound having at least two C=C double bonds per molecule and a molecular weight ranging from about 300 to 20,000.

3. The process of claim 1, wherein said unsaturated organic compound is an acryl ester of an aliphatic polyurethane, an acryl ester of a terephthalic acid-diol or polyol-polyester, an acryl ester of a dihydric or polyhydric polyether alcohol, an acryl ester of methylolmelamine resin, a maleic acid ester of a polyester, an acryl ester of a bisphenol A-epoxy resin, an unsaturated polyester resin, a styrene/butadiene copolymer resin, an acrylic acid ester of hydrolyzed starch or hydrolyzed cellulose, a fumaric acid-diol-polyester, an acrylic acid ester or a methacrylic acid ester of a monohydric or dihydric alcohol having at least one $—CH_2—$group present, an acrylic acid ester or a methacrylic acid ester of a monohydric or dihydric ether alcohol having a $—(CH_2—CH_2—O)—$ group wherein n is 1 or $>1$, a mono-, di-, tri-, tetra- or pentaacrylate of a polyhydric alcohol, cyanoethyl acrylate, glycidyl acrylate or methacrylate, allyl acrylate, cyclohexyl methacrylate, diallyl fumarate or divinylbenzene.

4. The process of claim 1, wherein said layer of a composition containing an unsaturated organic compound additionally contains an unhardenable resin having a molecular weight of about 1,000 to about 7,000 and selected from the group consisting of a cellulose ester, a polyvinyl butyral, a polyvinyl acetate, a vinyl acetate copolymer, an unhardenable polyester resin, a styrene/acrylate resin or a polystyrene resin.

5. The process of claim 1, wherein said inorganic white pigment is $TiO_2$, ZnO, $SiO_2$, $BaSO_4$, $CaSO_4$, $CaCO_3$, talc or clay.

6. The process of claim 1, wherein said first irradiation with electron beams is to an extent of a conversion of the unsaturated organic compound of about 80% or less; and the further irradiation with electron beams is to a conversion of more than 80%.

7. The process of claim 1, wherein the first irradiation of the layer with the electron beams is to an absorbed dose of up to about 1 M Rad, and the further irradiation is to an absorbed dose of about 1 to 10 M Rad.

* * * * *